US008421693B2

(12) United States Patent
Ohshima et al.

(10) Patent No.: US 8,421,693 B2
(45) Date of Patent: Apr. 16, 2013

(54) ANTENNA APPARATUS

(75) Inventors: Motoki Ohshima, Warabi (JP); Jinichi Inoue, Warabi (JP); Masashi Wakui, Warabi (JP); Nobuo Arayama, Warabi (JP)

(73) Assignee: Harada Industry Co., Ltd., Tokyo (JP)

( * ) Notice: Subject to any disclaimer, the term of this patent is extended or adjusted under 35 U.S.C. 154(b) by 457 days.

(21) Appl. No.: 12/449,151

(22) PCT Filed: Aug. 22, 2008

(86) PCT No.: PCT/JP2008/064973

§ 371 (c)(1),
(2), (4) Date: Jul. 24, 2009

(87) PCT Pub. No.: WO2009/069351

PCT Pub. Date: Jun. 4, 2009

(65) Prior Publication Data

US 2010/0013724 A1 Jan. 21, 2010

(30) Foreign Application Priority Data

Nov. 30, 2007 (JP) ..... 2007-309993

(51) Int. Cl.
*H01Q 1/32* (2006.01)
*H01Q 21/00* (2006.01)

(52) U.S. Cl.
USPC ..... 343/713; 343/725

(58) Field of Classification Search ..... 343/700 MS, 343/711, 713, 715, 725, 745, 729, 872, 712, 343/893
See application file for complete search history.

(56) References Cited

U.S. PATENT DOCUMENTS

| | | | | |
|---|---|---|---|---|
| 5,610,620 | A * | 3/1997 | Stites et al. | 343/725 |
| 6,486,841 | B1 * | 11/2002 | Imahigashi | 343/715 |
| 6,714,164 | B2 * | 3/2004 | Shimizu | 343/715 |
| 2003/0076264 | A1 | 4/2003 | Yuanzhu | |
| 2007/0241973 | A1 | 10/2007 | Cho et al. | |

FOREIGN PATENT DOCUMENTS

| | | |
|---|---|---|
| JP | A-8-186420 | 7/1996 |
| JP | A-2000-77923 | 3/2000 |
| JP | A-2003-142931 | 5/2003 |
| JP | A-2003-188619 | 7/2003 |
| JP | A-2005-223957 | 8/2005 |
| JP | A-2007-116232 | 5/2007 |
| JP | A-2007-288757 | 11/2007 |

* cited by examiner

*Primary Examiner* — Jacob Y Choi
*Assistant Examiner* — Hasan Islam
(74) *Attorney, Agent, or Firm* — Oliff & Berridge, PLC

(57) ABSTRACT

Good electric characteristics are obtained even after an antenna being further incorporated into an antenna apparatus including an antenna case having a limited space. An antenna device 31 is formed on an antenna substrate 30 installed upright in an antenna base 20. A flat antenna unit 35 is fastened to the antenna base 20 so that the flat antenna unit 35 is immediately below the antenna device 31. If the wavelength of a center frequency in an operating frequency band of the flat antenna unit 35 is λ, an interval between an upper surface of the flat antenna unit 35 and a lower end of the antenna device 31 is set to about 0.25 λ or more. Accordingly, it becomes possible to make directional characteristics of radiation in a horizontal plane of the flat antenna unit 35 non-directive without being affected by the antenna device 31 and also to achieve good gain characteristics.

4 Claims, 12 Drawing Sheets

ANTENNA APPARATUS

TECHNICAL FIELD

The present invention relates to a low-profile antenna apparatus mounted on a vehicle capable of receiving at least FM broadcasting.

BACKGROUND ART

A prior antenna apparatus mounted on a vehicle is generally an antenna apparatus capable of receiving AM broadcasting and FM broadcasting. A prior antenna apparatus uses a rod antenna of about 1 m in length to receive AM broadcasting and FM broadcasting. The length of the rod antenna corresponds to about ¼ wavelength in the FM wave band, but when compared with a wavelength in the AM wave band, the length thereof is far shorter and thus, sensitivity thereof declines dramatically. Therefore, a high-impedance cable has been used to increase the impedance of a rod antenna for the AM wave band or an amplifier in the AM wave band has been used to ensure sensitivity. Moreover, an on-vehicle antenna apparatus in which the length of antenna is reduced to about 180 mm to 400 mm by adopting a helically wound helical antenna for the rod part of the antenna is used. However, an amplifier is placed immediately below the antenna to compensate for performance degradation due to a reduced rod part.

FIG. 23 shows a configuration in which a prior antenna apparatus 101 whose rod part is made shorter is mounted on a vehicle 102. As shown in FIG. 23, the prior antenna apparatus 101 is mounted on the roof of the vehicle 102 and a height h10 of the antenna apparatus 101 sticking out from the vehicle 102 is set to about 200 mm. A helically wound helical antenna is adopted for the rod part of the antenna apparatus 101. Since, as described above, the antenna apparatus 101 sticks out from the vehicle 102, the rod part thereof may be broken by collision when the vehicle 102 is parked in a garage or washed. Thus, an antenna apparatus whose rod part can be pushed down to be in alignment with the roof of the vehicle 102 is also known.

Patent document 1: Japanese Publication Unexamined Patent Application No. 2005-223957

Patent document 2: Japanese Publication Unexamined Patent Application No. 2003-188619

DISCLOSURE OF THE INVENTION

Problems that the Invention is Intended to Solve

The prior antenna apparatus 101 described above has problems that beauty and design of a vehicle are damaged by a rod part prominently sticking out and also antenna performance remains lost if the rod part pushed down for parking in a garage or washing is forgotten to be raised. In addition, the antenna apparatus 101 is exposed to the outside of a vehicle and thus may be robbed. Therefore, an on-vehicle antenna apparatus whose antenna is housed in an antenna case can be considered. In this case, the height of the antenna apparatus sticking out from the vehicle is restricted to a predetermined height by vehicle external projection regulations and also the length in the longitudinal direction is suitably about 160 to 220 mm so that beauty of the vehicle is not damaged. Then, radiation resistance Rrad of such miniaturized antenna will be determined approximately in proportion to the square of the height, as represented by $600–800\times(\text{height}/\text{wavelength})^2$. If, for example, the height of an antenna is reduced from 180 mm to 60 mm, sensitivity thereof is degraded by as much as about 10 dB. Accordingly, if an existing rod antenna is simply reduced in length, performance thereof is significantly degraded, making practical use difficult. Further, if an antenna is made a low profile of 70 mm or less, the radiation resistance Rrad becomes smaller and radiation efficiency is more likely to deteriorate due to an influence of conductor loss of the antenna itself, leading to further sensitivity degradation.

Thus, the applicant proposed a vehicle mountable antenna apparatus capable of suppressing a decline in sensitivity even with a low profile of 70 mm or less in Japanese Patent Application No. 2006-315297. Incidentally, antennas for various uses such as terrestrial radio broadcasting, satellite radio broadcasting, and GPS may be mounted on a vehicle. However, as antennas conforming to various media increase, the number of antennas mounted on a vehicle increases, damaging beauty of the vehicle and increasing working hours for mounting. Thus, incorporating a plurality of antennas into an antenna apparatus can be considered. As an example, FIG. 24 shows a plan view showing a configuration example of an antenna apparatus obtained by incorporating an antenna for receiving, for example, SDARS (Satellite Digital Audio Radio Service) into the proposed antenna apparatus and FIG. 25 shows a side view of the configuration example of the antenna apparatus.

An antenna apparatus 200 shown in FIG. 24 and FIG. 25 includes an antenna case 210, an antenna base 220 housed in the antenna case 210, and an antenna substrate 230 and an amplifier substrate 234 mounted on the antenna base 220. The antenna case 210 has a streamlined external shape with an ever thinner tip. The metallic antenna base 220 is mounted on the bottom of the antenna case 210. Patterns of an antenna device 231 are formed on the antenna substrate 230 so large as to be housed upright in the antenna case 210. The interval between the lower edge of the antenna device 231 and the antenna base 220 is set to about 10 mm or more. The antenna substrate 230 is fastened upright to the antenna base 220 and also the amplifier substrate 234 is fastened in front of the antenna substrate 230. Moreover, a flat antenna unit 235 is fastened onto the amplifier substrate 234. The flat antenna unit 235 includes a patch element including perturbation element and capable of receiving circular polarization. The reason why the flat antenna unit 235 is fastened onto the amplifier substrate 234 is that the flat antenna unit 235 cannot be installed below the antenna device 231 due to the height of the flat antenna unit 235 and the only place in the antenna case 210 having a limited space where the flat antenna unit 235 can be installed is on the amplifier substrate 234.

A bolt part 221 for mounting the antenna apparatus 200 on a vehicle and a cable outlet 222 through which a cable for leading a signal received from the antenna apparatus 200 into a vehicle is pulled out are formed by sticking out from the bottom of the antenna base 220. In this case, holes into which the bolt part 221 and the cable outlet 222 are inserted are formed on the roof of the vehicle and the antenna apparatus 200 is placed on the roof in such a way that the bolt part 221 and the cable outlet 222 are inserted into these holes. Then, the antenna apparatus 200 can be fastened to the roof of the vehicle by tightening a nut to the bolt part 221 sticking out into the vehicle. At this point, the cable pulled out of the cable outlet 222 is introduced into the vehicle. A feeder cable to the amplifier substrate 234 housed in the antenna case 210 is introduced into the antenna case 210 from inside the vehicle via the cable outlet 222. The length of the antenna case 210 in the longitudinal direction is set to about 200 mm and the width thereof to about 75 mm. The height sticking out from the vehicle is set to about 70 mm and a low profile.

FIG. 26 shows directional characteristics of radiation in a horizontal plane of the antenna apparatus 200. The elevation angle is set to 20°. Reference to directional characteristics of radiation in FIG. 26 shows that the antenna apparatus 200 is not non-directional and particularly directional characteristics of radiation drop in the direction (180°) in which the antenna device 231 is present. This is because the installation height of the flat antenna unit 235 installed on the amplifier substrate 234 becomes higher and the interval between a ground surface and a patch element of the flat antenna unit 235 increases, affecting electric characteristics, particularly directional characteristics of radiation of the flat antenna unit. Further, the antenna device 231, which is a metal body as large as half the wavelength or so of the operating frequency of the flat antenna unit 235, is present in the range of low elevation angle radiation in a radiation field of the flat antenna unit 235 and directional characteristics of radiation of the flat antenna unit 235 are thereby significantly degraded under the influence of reflection, diffraction and like caused by the antenna device 231. Thus, there is a problem that if an antenna is further incorporated into an antenna apparatus having an antenna case with a limited space, good electric characteristics cannot be obtained due to an influence of existing antennas.

Therefore, an object of the present invention is to provide an antenna apparatus having an antenna case with a limited space that can still exhibit good electric characteristics even after an antenna being further incorporated into.

Means for Solving the Problem

To achieve the above object, the present invention includes an antenna substrate installed upright and on which a surface antenna device is formed, an amplifier substrate installed so as not to overlap with the antenna substrate, and a flat antenna unit installed immediately below the antenna device and approximately perpendicular to a surface of the antenna device, wherein if a wavelength of a center frequency in an operating frequency band of the flat antenna unit is λ, an interval between an upper surface of the flat antenna unit and a lower end of the antenna device is about 0.25λ or more.

Effect of the Invention

According to the present invention, an antenna apparatus includes an antenna substrate installed upright and on which a surface antenna device is formed, an amplifier substrate installed so as not to overlap with the antenna substrate, and a flat antenna unit installed immediately below the antenna device and approximately perpendicular to a surface of the antenna device, wherein if a wavelength of a center frequency in an operating frequency band of the flat antenna unit is λ, an interval between an upper surface of the flat antenna unit and a lower end of the antenna device is about 0.25λ or more. Therefore, directional characteristics of radiation in a horizontal plane of the flat antenna unit can be made non-directional without being affected by the antenna device and also good gain characteristics can be obtained.

EXPLANATION OF THE REFERENCE SYMBOLS

Figure 1:
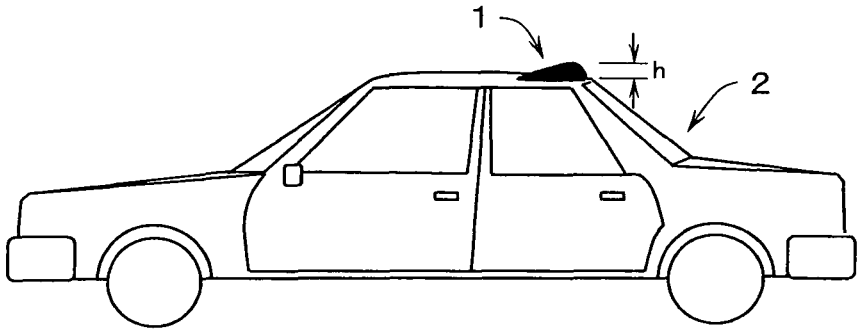
FIG. 1 is a diagram showing a configuration of a vehicle on which an antenna apparatus according to an embodiment of the present invention is mounted.

1: Antenna apparatus
2: Vehicle
3: Antenna apparatus
10: Antenna case
20: Antenna base
21: Bolt part
22: Cable outlet
23: Substrate fixing part
24: Boss
25: Mounting hole
30: Antenna substrate
30*a*: Notch
31: Antenna device
32: Antenna coil
34: Amplifier substrate
35: Flat antenna unit
40: Antenna part
41: Antenna device
42: Insulating spacer
42*a*: Notch
43: Mounting screw
101: Antenna apparatus
102: Vehicle
200: Antenna apparatus
210: Antenna case
220: Antenna base
221: Bolt part
222: Cable outlet
230: Antenna substrate
231: Antenna device
234: Amplifier substrate
235: Flat antenna unit

BEST MODE FOR CARRYING OUT THE INVENTION

FIG. 1 shows the configuration of a vehicle on which an antenna apparatus according to an embodiment of the present invention is mounted. As shown in FIG. 1, an antenna apparatus 1 in the first embodiment according to the present invention is mounted on a roof of a vehicle 2 and a height h sticking out from the vehicle 2 is about 75 mm or less and suitably about 70 mm or less. The antenna apparatus 1 in the first embodiment includes an antenna case described later and is in an extremely low profile, but can receive AM broadcasting, FM broadcasting, and satellite radio broadcasting. The antenna apparatus 1 has a streamlined shape with an ever thinner tip and sides curved inward so that beauty and design of a vehicle are not damaged. Then, the bottom of the antenna apparatus 1 has a shape fitting to that of a mounting surface of the vehicle 2 and is mounted on the vehicle 2 with water tightness.

Figure 2:
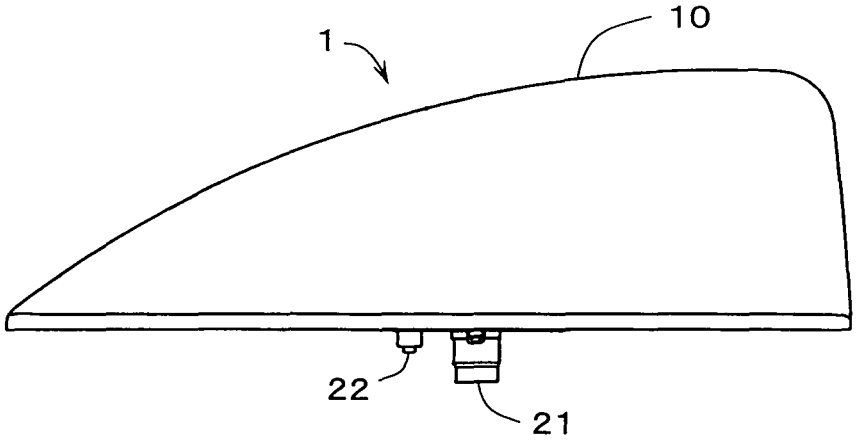
FIG. 2 is a side view showing the configuration of the antenna apparatus in a first embodiment according to the present invention.
Figure 3:
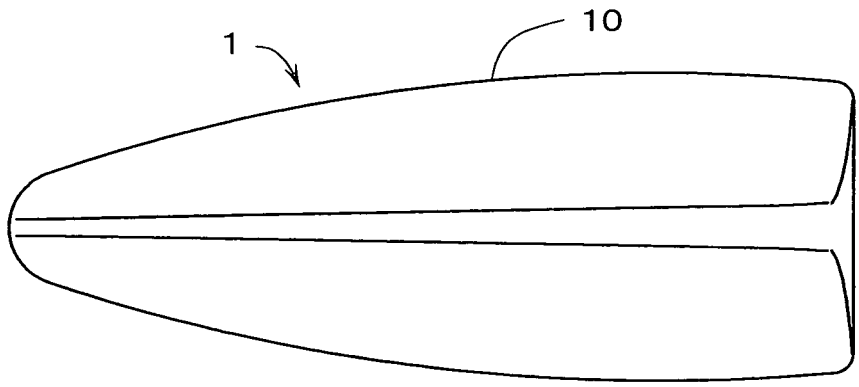
FIG. 3 is a plan view showing the configuration of the antenna apparatus in the first embodiment according to the present invention.
Figure 4:
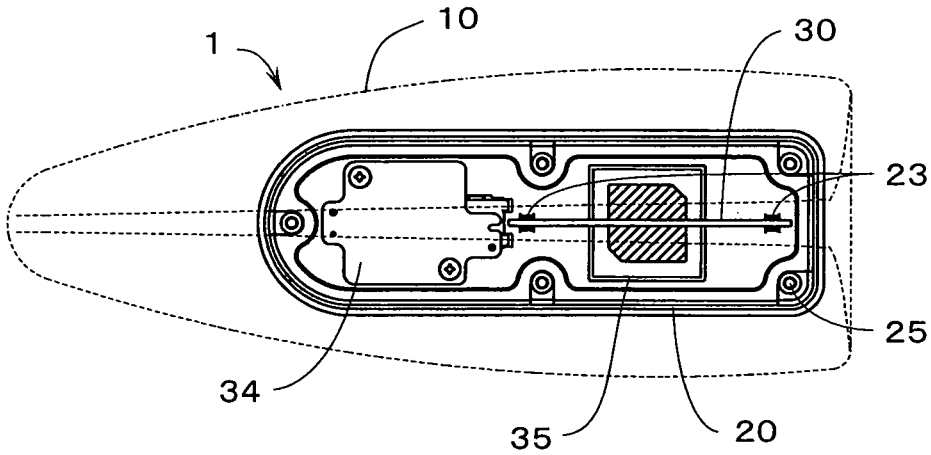
FIG. 4 is a plan view showing the internal configuration of the antenna apparatus in the first embodiment according to the present invention.
Figure 5:
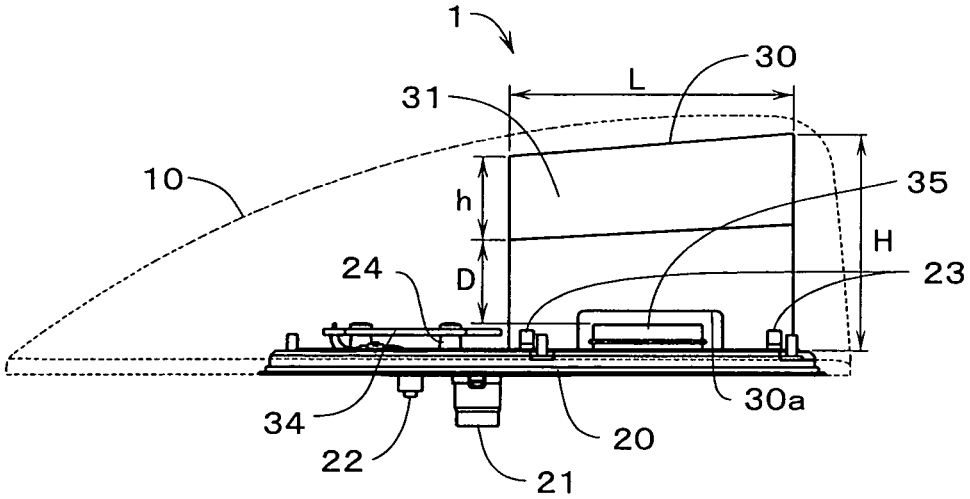
FIG. 5 is a side view showing the internal configuration of the antenna apparatus in the first embodiment according to the present invention.
Figure 6:
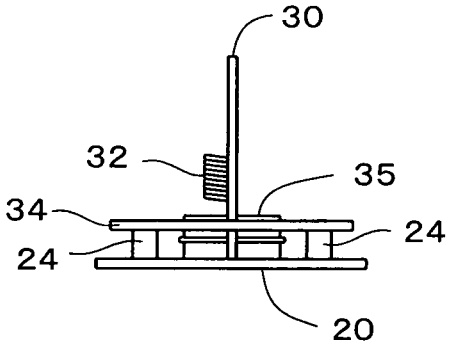
FIG. 6 is a front view showing the internal configuration by omitting an antenna case according to the antenna apparatus in the first embodiment of the present invention.

Next, FIG. 2 to FIG. 6 show the configuration of the on-vehicle antenna apparatus 1 in the first embodiment of the present invention. FIG. 2 is a side view showing the configuration of the antenna apparatus 1 in the first embodiment according to the present invention, FIG. 3 is a plan view showing the configuration of the antenna apparatus 1 according to the present invention, FIG. 4 is a plan view showing the internal configuration of the antenna apparatus 1 in the first embodiment according to the present invention, FIG. 5 is a side view showing the internal configuration of the antenna apparatus 1 in the first embodiment according to the present invention, and FIG. 6 is a front view showing the internal configuration of the antenna apparatus 1 in the first embodiment by omitting an antenna case.

As shown in these figures, the antenna apparatus 1 according to the first embodiment of the present invention includes an antenna case 10, an antenna base 20 housed in the antenna case 10, an antenna substrate 30 mounted on the antenna base 20, an amplifier substrate 34, and a flat antenna unit 35. The length of the antenna case 10 in the longitudinal direction is set to about 200 mm and the width thereof to about 75 mm.

The antenna case 10 is made of radio wave transmitting synthetic resin and has a streamlined external shape with an ever thinner tip and sides curved inward. The bottom of the antenna case 10 has a shape fitting to that of the mounting surface of the vehicle 2. Inside the antenna case 10, a space allowing the antenna substrate 30 to be housed upright and a space to house the amplifier substrate 34 almost in parallel with the antenna base 20 are formed. The metallic antenna base 20 is mounted on the bottom of the antenna case 10. Then, the antenna substrate 30 is fastened upright to the antenna base 20 and also the amplifier substrate 34 is fastened to the antenna base 20 so as to be positioned in front of the antenna substrate 30. A notch 30*a* in a rectangular shape is formed in a central part at the lower edge of the antenna substrate 30 and the flat antenna unit 35 is mounted on the antenna base 20 so as to be positioned inside the notch 30*a*. By mounting the antenna base 20 on the bottom of the antenna case 10, the antenna substrate 30, the amplifier substrate 34, and the flat antenna unit 35 can be housed in an internal space of the antenna case 10. The antenna substrate 30 is suitably made higher with an upper edge of the antenna substrate 30 fastened upright having a shape fitting to that of the internal space of the antenna case 10.

A bolt part 21 for mounting the antenna apparatus 1 on the vehicle 2 and a cable outlet 22 through which a cable for leading a signal received from the antenna apparatus 1 into the vehicle 2 is pulled out are formed by sticking out from the bottom of the antenna base 20. In this case, holes into which the bolt part 21 and the cable outlet 22 are inserted are formed on the roof of the vehicle 2 and the antenna apparatus 1 is placed on the roof in such a way that the bolt part 21 and the cable outlet 22 are inserted into these holes. Then, the antenna apparatus 1 can be fastened to the roof of the vehicle 2 by tightening a nut to the bolt part 21 sticking out into the vehicle 2. At this point, the cable pulled out of the cable outlet 22 acting also as a positioning projection is introduced into the vehicle 2. A feeder cable to the amplifier substrate 34 housed in the antenna case 10 is introduced into the antenna case 10 from inside the vehicle 2 via the cable outlet 22.

The antenna base 20 consists of an elongated flat plate in an approximately rectangular shape with a semicircular shape on one side and has a pair of substrate fixing parts 23 to upright install and retain the antenna substrate 30 by sandwiching an edge of the antenna substrate 30 formed on the front side. Further, a pair of bosses 24 is formed sticking out to support the amplifier substrate 34 by screwing the amplifier substrate 34. Moreover, five mounting holes 25 into which screws are inserted for amounting the antenna base 20 on the antenna case 10 are formed on the periphery of the antenna base 20. Further, the bolt part 21 screwed on the peripheral side and the cable outlet 22 having a substantially rectangular sectional shape are formed sticking out from the underside of the antenna base 20. Accordingly, as shown in FIG. 4 and FIG. 5, the antenna substrate 30 is installed upright and fastened to the pair of substrate fixing parts 23 and the amplifier substrate 34 is fastened to the pair of bosses 24. Also, the flat antenna unit 35 is fastened by screwing or an adhesive to the front side of the antenna base 20 inside the notch 30*a* of the antenna substrate 30 installed upright and fastened. Then, a cable connected to output of the amplifier substrate 34 and that pulled out of the flat antenna unit 35 are pulled out downward through the cable outlet 22.

The antenna substrate 30 is a printed board such as a glass epoxy substrate having good high frequency characteristics and has patterns of an antenna device 31 constituting an antenna capable of receiving AM broadcasting and FM broadcasting formed in an upper part thereof. The height of the antenna substrate 30 from the antenna base 20 is set as H and the length thereof as L. The length of the antenna device 31 is set as L like the antenna substrate 30 and the width (height) thereof ash. Further, the interval between the lower edge of the antenna device 31 and the upper surface of the flat antenna unit 35 is set as D. The size of the antenna device 31 is limited by restrictions of the internal space of the antenna case 10 to the height H of up to about 75 mm and the length L of up to about 90 mm. Here, if the wavelength of the frequency 100 MHz in the FM wave band is λ, the dimension of about 75 mm corresponds to about 0.025λ and that of about 90 mm to about 0.03λ so that the antenna device 31 is an ultra-small antenna with respect to the wavelength λ.

Incidentally, if the ultra-small antenna device 31 is adopted, it becomes difficult to resonate the antenna device 31 in the FM wave band because the inductor component becomes smaller. Thus, by inserting an antenna coil 32 of about 1 μH to 3 μH to between a feeding point of the antenna device 31 and input of an amplifier in the amplifier substrate 34 in series, an antenna part consisting of the antenna device 31 and the antenna coil 32 is made to be resonated near the FM waveband. The antenna coil 32 is shown in FIG. 6. Accordingly, the antenna part consisting of the antenna device 31 and the antenna coil 32 will be able to operate excellently in the FM wave band. By using the antenna device 31 resonating in the FM wave band as a voltage receiving device in the AM wave band, the AM wave band is made receivable. In addition, the antenna device 31 is a surface antenna device of the length L and the width h and thus, a conductor loss thereof is small so that degradation in electric characteristics due to the conductor loss can be prevented.

The amplifier provided on the amplifier substrate 34 amplifies and outputs an FM broadcasting signal and an AM broadcasting signal received by the antenna device 31.

In the antenna apparatus 1 in the first embodiment of the present invention, as described above, the flat antenna unit 35 to receive satellite radio broadcasting is installed immediately below the antenna device 31 for receiving AM/FM. The flat antenna unit 35 includes a patch element including a perturbation element and capable of receiving circular polarization. Generally, if two antennas are installed close to each other, gain characteristics may deteriorate or directional characteristics of radiation may be disturbed. Thus, FIG. 7 to FIG. 11 show gain characteristics of the flat antenna unit 35 when the elevation angle is set to 20° to 60°, which is specified as the satellite receiving elevation angle range of a satellite digital radio, using the interval D between the lower edge of the antenna device 31 and the upper surface of the flat antenna unit 35 in the antenna apparatus 1 according to the present invention as a parameter. The antenna device 31 in this case has the length L of about 60 mm and the width h in the longitudinal direction of about 28 mm.

Figure 7:
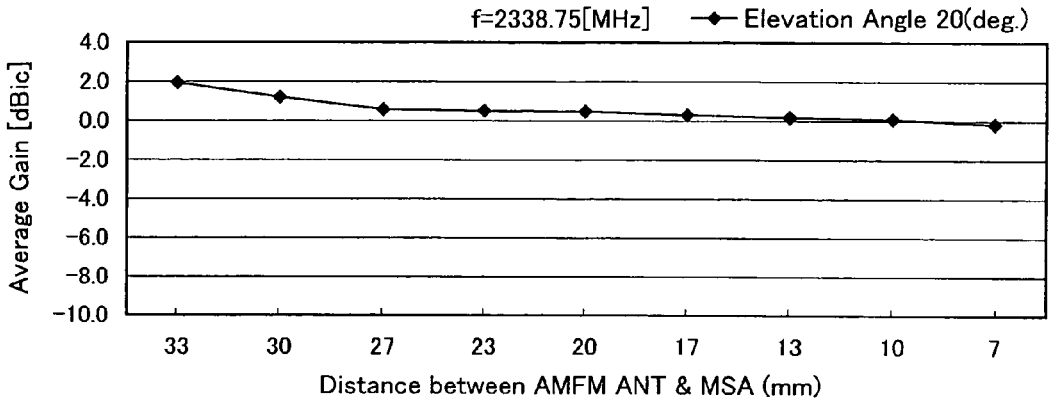
FIG. 7 is a diagram showing gain characteristics when an elevation angle of a flat antenna unit in the antenna apparatus in the first embodiment of the present invention is 20°.

In FIG. 7, the frequency is set to 2338.75 MHz, which is the center frequency of the satellite digital radio broadcasting (SDARS), and the elevation angle to 20°, gain characteristics of the flat antenna unit 35 when the interval D changes from 33 mm to 7 mm are shown, and the horizontal axis is set as the interval D (mm) and the vertical axis as an average gain [dBic]. Reference to gain characteristics shown in FIG. 7 shows that the maximum gain of about 2.0 [dBic] is obtained when the interval D is 33 mm, the average gain attenuates with the decreasing interval D up to 7 mm, and the gain attenuates to the minimum gain of about 0 [dBic] when the interval D is 7 mm. Here, the unit dBic represents an absolute gain over an isotropic antenna (a virtual antenna that radiates power uniformly in all directions) of circular polarization.

Figure 8:
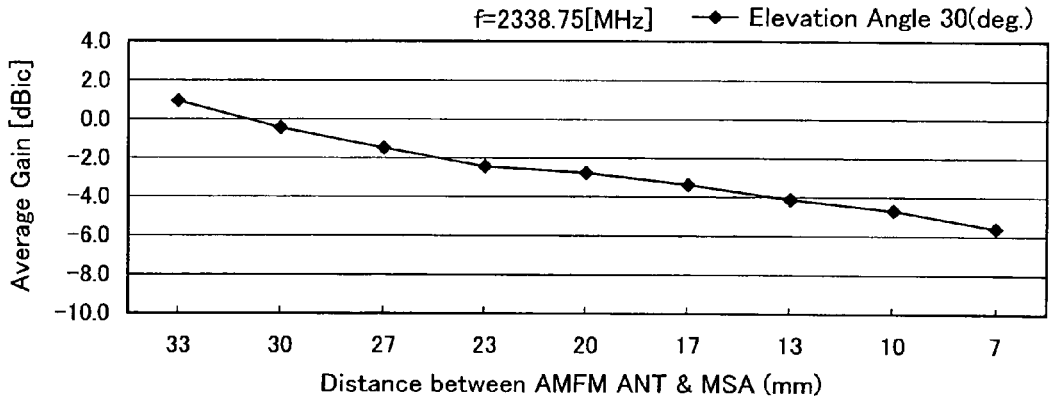
FIG. 8 is a diagram showing gain characteristics when the elevation angle of the flat antenna unit in the antenna apparatus in the first embodiment of the present invention is 30°.

In FIG. 8, the frequency is set to 2338.75 MHz and the elevation angle to 30° and gain characteristics of the flat antenna unit 35 when the interval D changes from 33 mm to 7 mm are shown. Reference to gain characteristics shown in FIG. 8 shows that the maximum gain of about 1.0 [dBic] is obtained when the interval D is 33 mm, the average gain gradually attenuates with the decreasing interval D up to 7 mm, and the gain attenuates to the minimum gain of about −5.5 [dBic] when the interval D is 7 mm.

Figure 9:
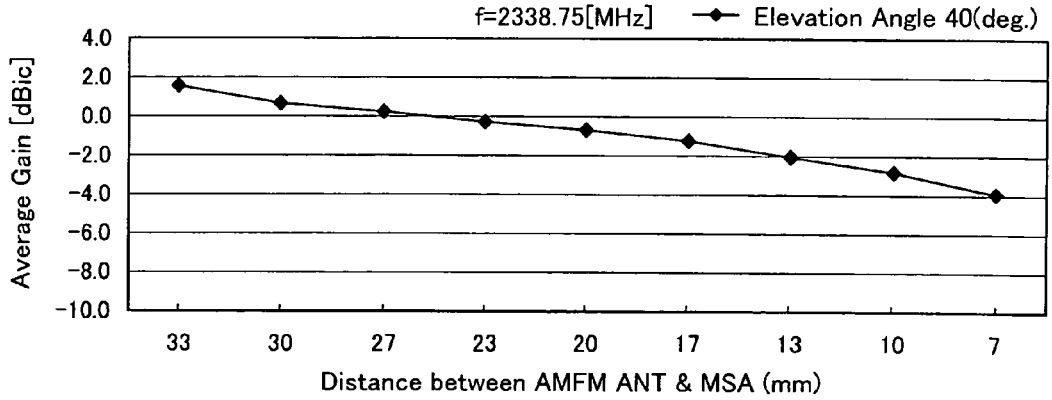
FIG. 9 is a diagram showing gain characteristics when the elevation angle of the flat antenna unit in the antenna apparatus in the first embodiment of the present invention is 40°.

Further, in FIG. 9, the frequency is set to 2338.75 MHz and the elevation angle to 40° and gain characteristics of the flat antenna unit 35 when the interval D changes from 33 mm to 7 mm are shown. Reference to gain characteristics shown in FIG. 9 shows that the maximum gain of about 1.8 [dBic] is obtained when the interval D is 33 mm, the average gain gradually attenuates with the decreasing interval D up to 7 mm, and the gain attenuates to the minimum gain of about −4.0 [dBic] when the interval D is 7 mm.

Figure 10:
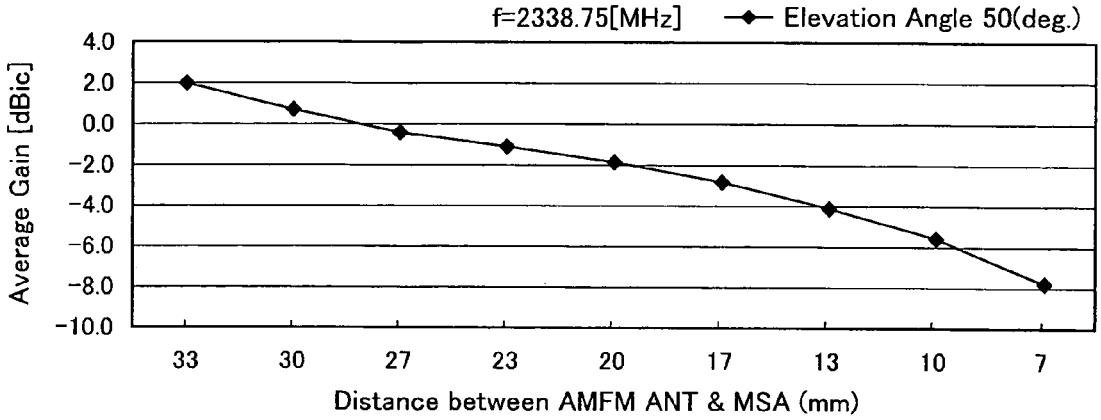
FIG. 10 is a diagram showing gain characteristics when the elevation angle of the flat antenna unit in the antenna apparatus in the first embodiment of the present invention is 50°.

Further, in FIG. 10, the frequency is set to 2338.75 MHz and the elevation angle to 50° and gain characteristics of the flat antenna unit 35 when the interval D changes from 33 mm to 7 mm are shown. Reference to gain characteristics shown in FIG. 10 shows that the maximum gain of about 2.0 [dBic] is obtained when the interval D is 33 mm, the average gain gradually attenuates with the decreasing interval D up to 7 mm, and the gain attenuates to the minimum gain of about −7.9 [dBic] when the interval D is 7 mm.

Figure 11:
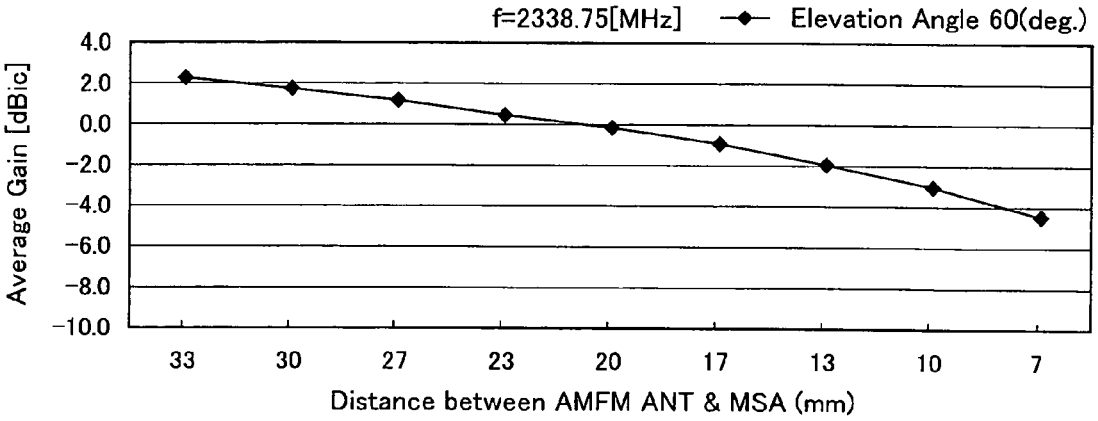
FIG. 11 is a diagram showing gain characteristics when the elevation angle of the flat antenna unit in the antenna apparatus in the first embodiment of the present invention is 60°.

Further, in FIG. 11, the frequency is set to 2338.75 MHz and the elevation angle to 60° and gain characteristics of the flat antenna unit 35 when the interval D changes from 33 mm to 7 mm are shown. Reference to gain characteristics shown in FIG. 11 shows that the maximum gain of about 2.1 [dBic] is obtained when the interval D is 33 mm, the average gain gradually attenuates with the decreasing interval D up to 7 mm, and the gain attenuates to the minimum gain of about −4.5 [dBic] when the interval D is 7 mm.

Reference to gain characteristics shown in FIG. 7 to FIG. 11 shows that better gain characteristics are exhibited with the increasing interval D and if the interval D is set to 33 mm or more, good gain characteristics can be obtained in the elevation angle range of 20° to 60°, which is specified as the satellite receiving elevation angle range of a satellite digital radio. The width h of the antenna device 31 in this case is set to about 28 mm. Moreover, the flat antenna unit 35 does not affect gain characteristics and directional characteristics of radiation of the antenna device 31 and the flat antenna unit 35 can be incorporated immediately below the antenna device 31 for integration by designing the interval D between the lower edge of the antenna device 31 and the upper surface of the flat antenna unit 35 at about 33 mm and the width h of the antenna device 31 at about 28 mm.

Figure 12:
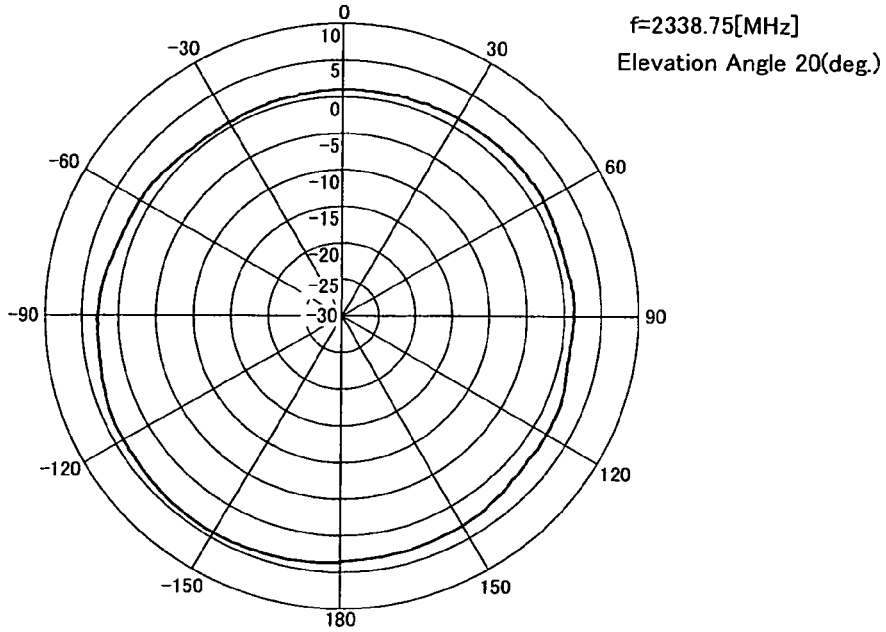
FIG. 12 is a diagram showing directional characteristics of radiation when the elevation angle of the flat antenna unit in the antenna apparatus in the first embodiment of the present invention is 20°.

Further, FIG. 12 shows directional characteristics of radiation in a horizontal plane of the flat antenna unit 35. The interval D is set to about 33 mm and the elevation angle to 20°. Reference to directional characteristics of radiation in FIG. 12 shows that almost non-directivity is obtained and directional characteristics of radiation are not affected even if the antenna device 31 is present immediately above the flat antenna unit 35. That is, the height of the flat antenna unit 35 fastened onto the antenna base 20 becomes lower, which makes the interval between the ground surface and the patch element of the flat antenna unit 35 smaller, so that electric characteristics, particularly directional characteristics of radiation of the flat antenna unit 35 are not affected. Moreover, by incorporating the flat antenna unit 35 immediately below the antenna device 31, an influence of directional characteristics of radiation of the flat antenna unit 35 installed immediately below the antenna device 31 is reduced to exhibit isotropic radiation. Thus, even if the flat antenna unit 35 is incorporated immediately below the antenna device 31 in the antenna apparatus 1 including the antenna case 10 having a limited space, non-directivity can be obtained without being affected by the antenna device 31 by setting the interval D there between to about 33 mm.

Here, a design technique of the antenna apparatus 1 in the first embodiment according to the present invention will be described. The flat antenna unit 35 is assumed to be an antenna for receiving SDARS (Satellite Digital Audio Radio Service) with the center frequency thereof of 2338.75 MHz. In this case, the wavelength λ of the center frequency of a satellite digital radio is about 128 mm and design values in terms of the wavelength λ will be represented as follows:

(1) The interval D between the lower edge of the antenna device 31 and the upper surface of the flat antenna unit 35 is set to about 0.25λ or more.

(2) The length L of the antenna device 31 is set to about 0.5λ or less.

(3) The width h in the longitudinal direction of the antenna device 31 is set to about 0.2λ to 0.25λ, or 0.2λ or less.

(4) The antenna device 31 is made to have a width in the longitudinal direction larger than a thickness thereof and makes prints on the antenna substrate 30 or has a plate shape with thickness of 1 to 2 mm.

By setting dimensions/spatial relationships of the antenna device 31 as described above, a mutual influence between the antenna device 31 and the flat antenna unit 35 is reduced so that equivalent electric characteristics of each antenna when each of the antenna device 31 and the flat antenna unit 35 is present alone can be exhibited.

Figure 13:
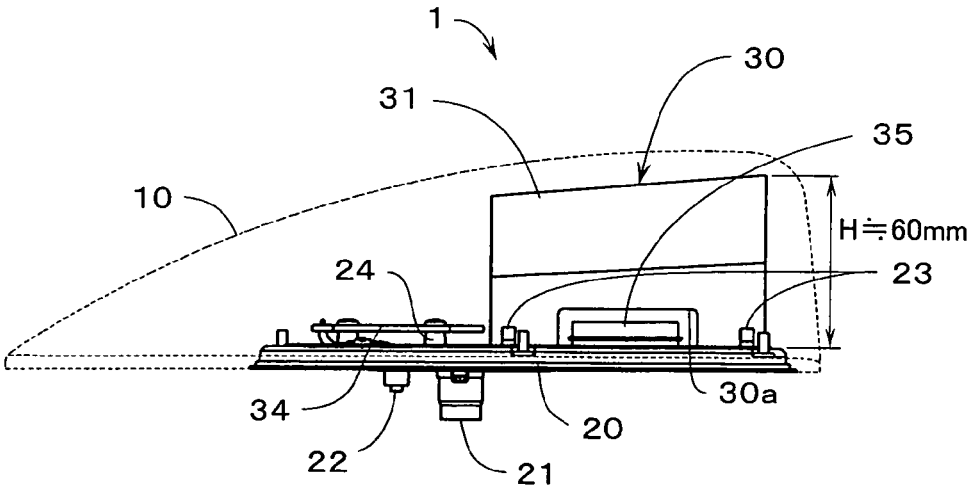
FIG. 13 is a side view showing the internal configuration when a height of an antenna device in the antenna apparatus in the first embodiment according to the present invention is set to 60 mm.
Figure 14:
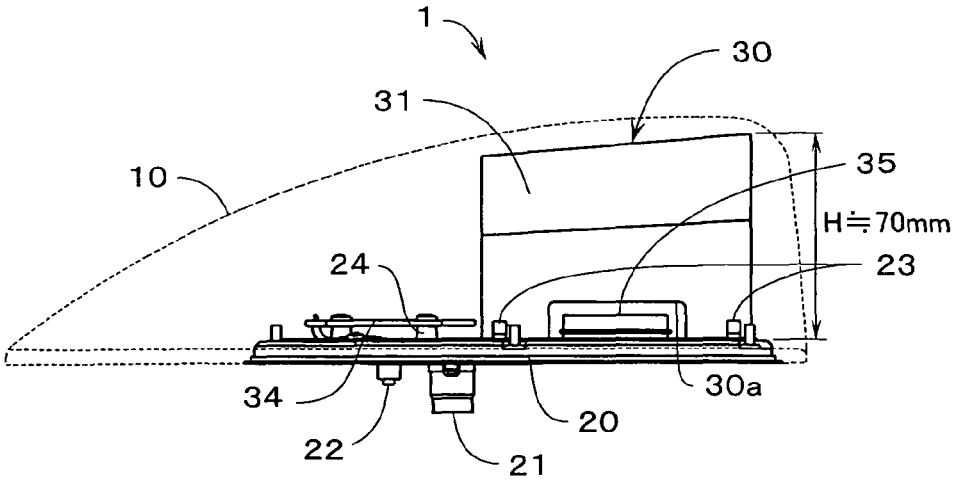
FIG. 14 is a side view showing the internal configuration when the height of the antenna device in the antenna apparatus in the first embodiment according to the present invention is set to 70 mm.
Figure 15:
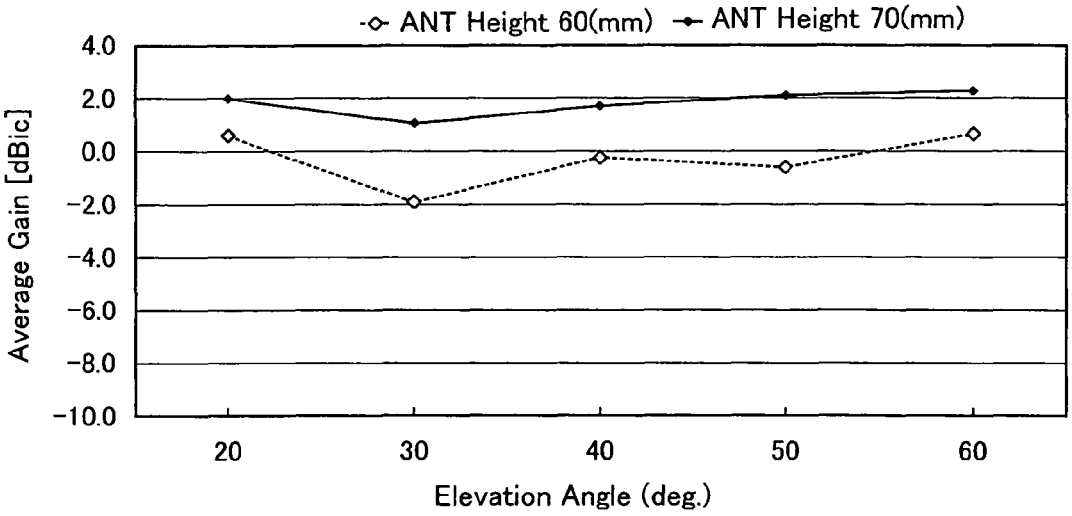
FIG. 15 is a diagram showing gain characteristics of the flat antenna unit when the height of the antenna device in the antenna apparatus in the first embodiment according to the present invention is changed.

Next, FIG. 13 shows the configuration of the antenna apparatus 1 with the height H from the ground of the antenna device 31 designed at about 60 mm (The height of the antenna apparatus 1 will be about 65 mm), FIG. 14 shows the configuration of the antenna apparatus 1 with the height H from the ground of the antenna device 31 designed at about 70 mm (The height of the antenna apparatus 1 will be about 75 mm), and FIG. 15 shows average gains of the flat antenna unit 35 when the height H of the antenna device 31 is set to about 60 mm and 70 mm and the elevation angle is changed.

Reference to FIG. 15 shows that when the height H of the antenna device 31 is set to about 60 mm, the average gain of about 0.5 [dBic] is obtained if the elevation angle is 20°, the average gain attenuates to about −2.0 [dBic] if the elevation angle is 30°, the average gain of about −0.2 [dBic] is obtained if the elevation angle is 40°, the average gain of about −0.5 [dBic] is obtained if the elevation angle is 50°, and the average gain of about 0.6 [dBic] is obtained if the elevation angle is 60°. When the height H of the antenna device 31 is set to about 70 mm, the average gain of about 2.0 [dBic] is obtained if the elevation angle is 20°, the average gain attenuates, but the average gain of about 1.0 [dBic] is obtained if the elevation angle is 30°, the average gain of about 1.8 [dBic] is obtained if the elevation angle is 40°, the average gain of about 2.0 [dBic] is obtained if the elevation angle is 50°, and the average gain of about 2.1 [dBic] is obtained if the elevation angle is 60°.

Thus, it is clear that there is a trend that the gain of the flat antenna unit 35 improves with the increasing height H of the antenna device 31.

Figure 16:
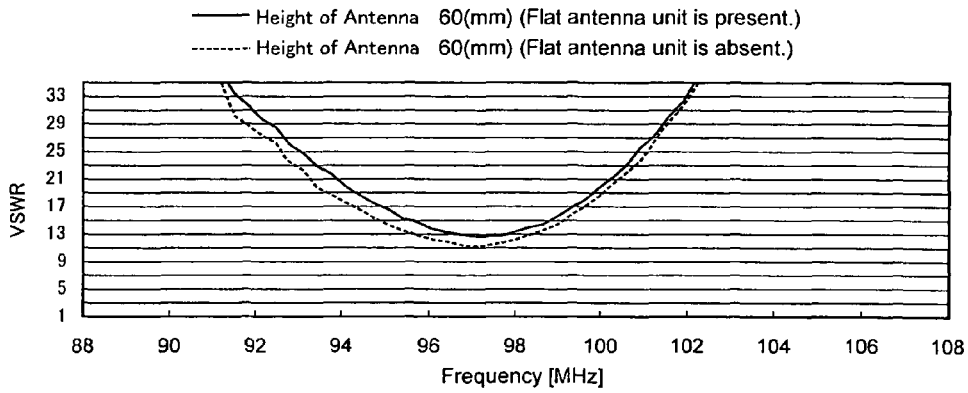
FIG. 16 is a diagram showing frequency characteristics of VSWR when the height of the antenna device in the antenna apparatus in the first embodiment according to the present invention is set to 60 mm and the flat antenna unit is present/absent.
Figure 17:
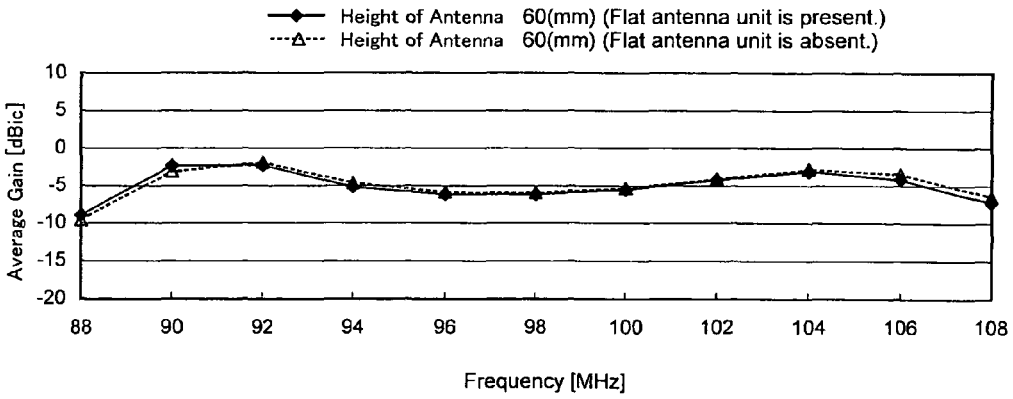
FIG. 17 is a diagram showing frequency characteristics of gain when the height of the antenna device in the antenna apparatus in the first embodiment according to the present invention is set to 60 mm and the flat antenna unit is present/absent.

Next, FIG. 16 shows frequency characteristics of a voltage standing wave ratio (VSWR) of the antenna device 31 depending on "presence" and "absence" of the flat antenna unit 35 and FIG. 17 shows frequency characteristics of the average gain of the antenna device 31 depending on "presence" and "absence" of the flat antenna unit 35 when the height H from the ground of the antenna device 31 is designed at about 60 mm (The height of the antenna apparatus 1 will be about 65 mm), as shown in FIG. 13, and the height H from the ground of the antenna device 31 is designed at about 70 mm (The height of the antenna apparatus 1 will be about 75 mm), as shown in FIG. 14.

The horizontal axis in FIG. 16 is set as the frequency of the frequency range in the FM wave band and the vertical axis as VSWR. Reference to FIG. 16 shows that while the resonance point is invariant for both cases of "absence" and "presence" of the flat antenna unit 35, degradation of about 1 to 2 of VSWR is observed in the FM wave band when the flat antenna unit 35 is "present". This can be considered to result from an influence of mutual interference of the flat antenna unit 35. Reference to FIG. 17 shows that highly similar gain values are obtained as the average gains in the FM wave band for both cases of "absence" and "presence" of the flat antenna unit 35 so that an influence of installation of the flat antenna unit 35 is hardly observed.

Figure 18:
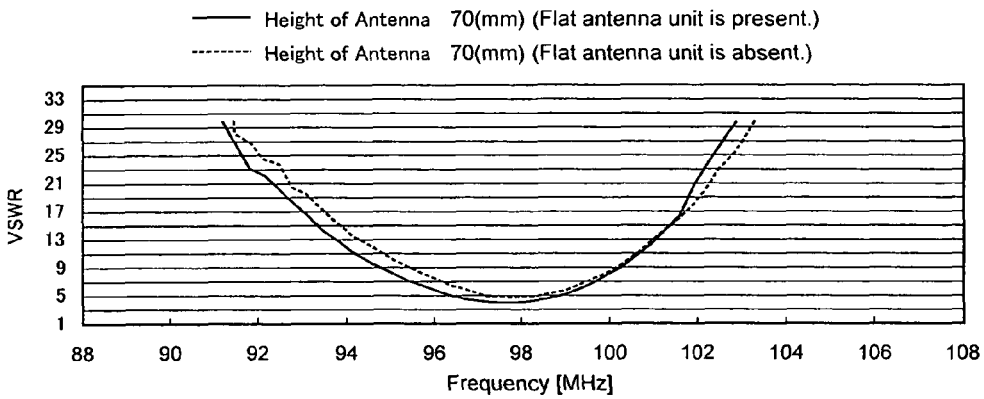
FIG. 18 is a diagram showing frequency characteristics of VSWR when the height of the antenna device in the antenna apparatus in the first embodiment according to the present invention is set to 70 mm and the flat antenna unit is present/absent.
Figure 19:
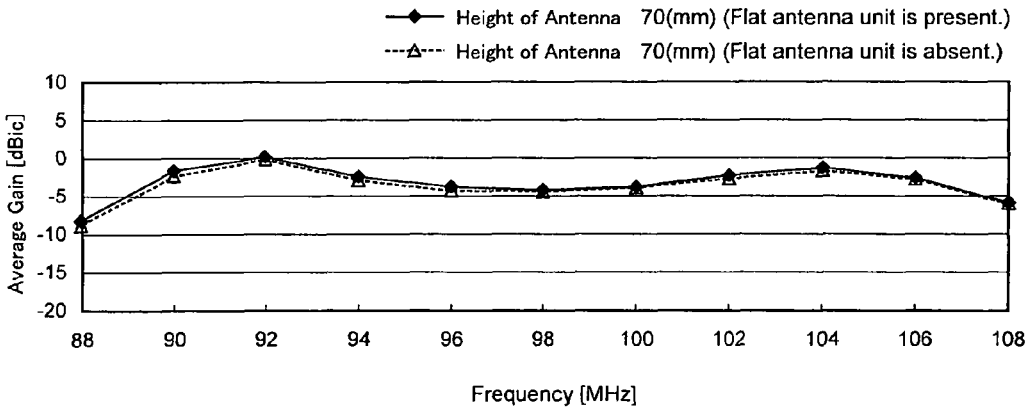
FIG. 19 is a diagram showing frequency characteristics of gain when the height of the antenna device in the antenna apparatus in the first embodiment according to the present invention is set to 70 mm and the flat antenna unit is present/absent.

Reference to FIG. 18 shows that while the resonance point is invariant for both cases of "absence" and "presence" of the flat antenna unit 35, the VSWR value in the FM wave band is more improved when the flat antenna unit 35 is "present". Further, reference to FIG. 19 shows that highly similar gain values are obtained as the average gains in the FM wave band for both cases of "absence" and "presence" of the flat antenna unit 35 so that an influence of installation of the flat antenna unit 35 is hardly observed. Further, frequency characteristics of VSWR shown in FIG. 18 exhibit far better VSWR values than those of VSWR shown in FIG. 16 in a wide frequency band and gain characteristics shown in FIG. 19 achieve improvement of 2 to 3 dB gain from those shown in FIG. 17 in a wide frequency band. Thus, electric characteristics of the antenna apparatus 1 can significantly be improved by setting the height H of the antenna device 31 to about 70 mm.

Figure 20:
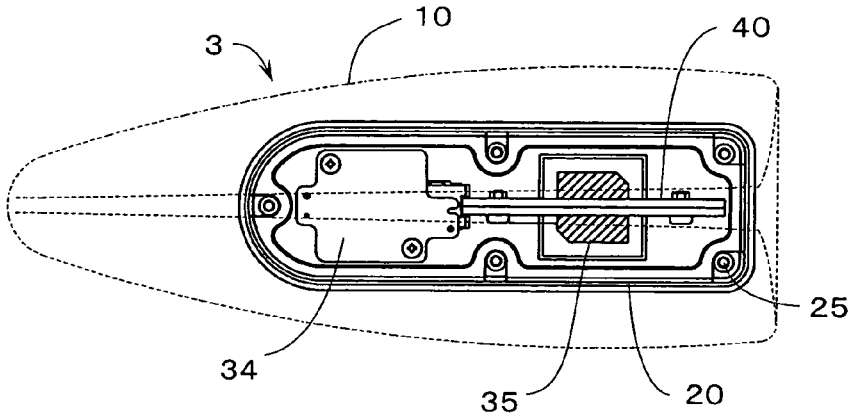
FIG. 20 is a plan view showing the internal configuration of an antenna apparatus in a second embodiment according to the present invention.
Figure 21:
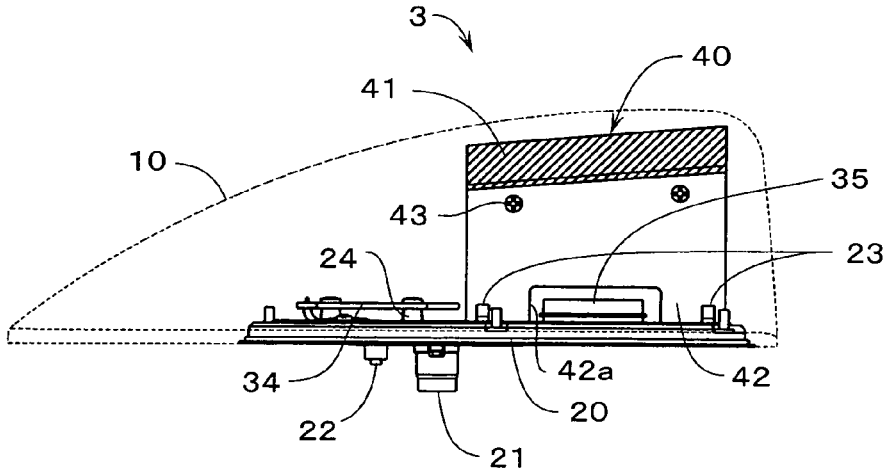
FIG. 21 is a side view showing the internal configuration of the antenna apparatus in the first embodiment according to the present invention.
Figure 22:
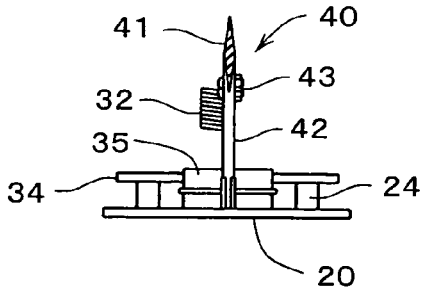
FIG. 22 is a front view showing the internal configuration by omitting the antenna case according to the antenna apparatus in the second embodiment of the present invention.
Figure 23:
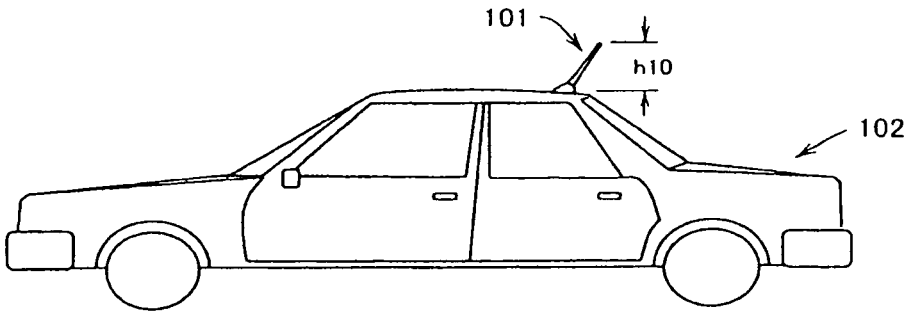
FIG. 23 Prior art
FIG. 23 is a diagram showing the configuration in which a prior antenna apparatus is mounted on a vehicle.
Figure 24:
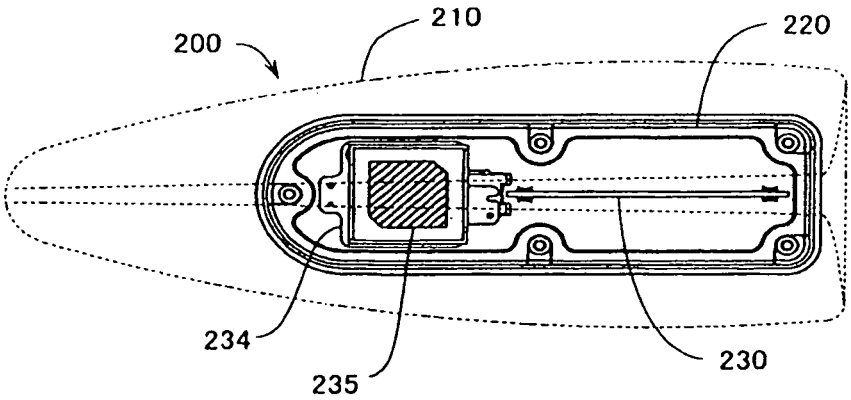
FIG. 24 Conventional Art
FIG. 24 is a plan view showing the internal configuration of the conventional antenna apparatus.
Figure 25:
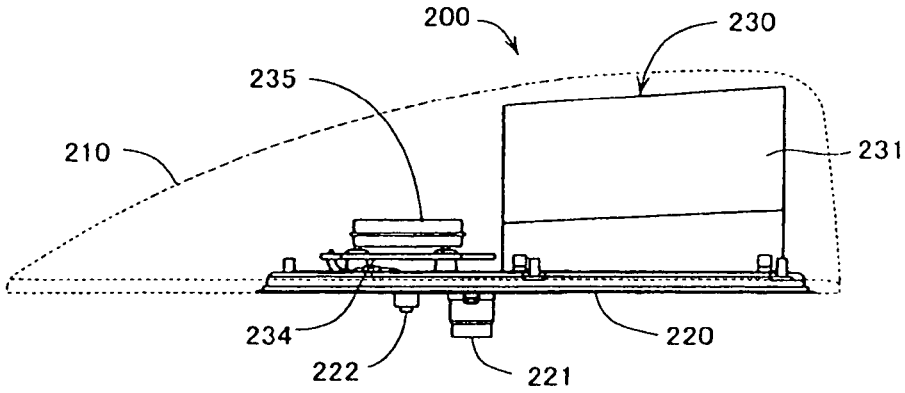
FIG. 25 Conventional Art
FIG. 25 is a side view showing the internal configuration of the conventional antenna apparatus.
Figure 26:
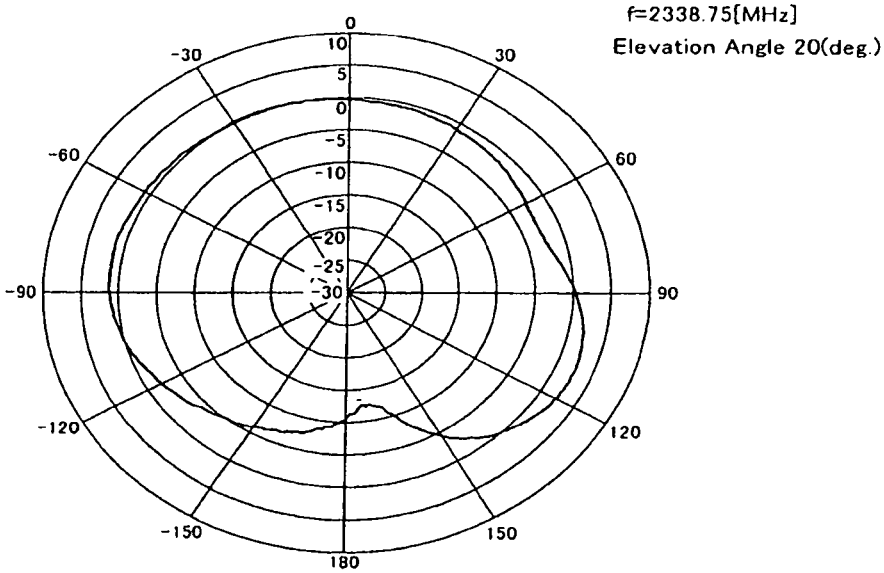
FIG. 26 Conventional Art
FIG. 26 is a diagram showing directional characteristics of radiation when the elevation angle of the flat antenna unit in the conventional antenna apparatus is 20°.

Next, the configuration of an on-vehicle antenna apparatus 3 in the second embodiment of the present invention is shown in FIG. 20 to FIG. 22. FIG. 20 is a plan view showing the internal configuration of the antenna apparatus 3 in the second embodiment according to the present invention, FIG. 21 is a side view showing the internal configuration of the antenna apparatus 3 in the second embodiment according to the present invention, and FIG. 22 is a front view showing the internal configuration of the antenna apparatus 3 in the second embodiment by omitting the antenna case.

As shown in these figures, the antenna apparatus 3 in the second embodiment of the present invention includes, instead of the antenna substrate 30 in the antenna apparatus 1 in the first embodiment, an antenna part 40. The antenna apparatus 3 in the second embodiment includes the antenna case 10, the antenna base 20 housed in the antenna case 10, the antenna part 40 mounted on the antenna base 20, the amplifier substrate 34, and the flat antenna unit 35. The length in the longitudinal direction of the antenna case 10 is set to about 200 mm and the width thereof to about 75 mm.

The antenna case 10 is made of radio wave transmitting synthetic resin and has a streamlined external shape with an ever thinner tip and sides curved inward. The bottom of the antenna case 10 has a shape fitting to that of the mounting surface of the vehicle 2. Inside the antenna case 10, a space allowing the antenna substrate 30 to be housed upright and a space to house the amplifier substrate 34 almost in parallel with the antenna base 20 are formed. The metallic antenna base 20 is mounted on the bottom of the antenna case 10. Then, the antenna part 40 is fastened upright to the antenna base 20 and also the amplifier substrate 34 is fastened to the antenna base 20 so as to be positioned in front of the antenna part 40. A notch 42*a* in a rectangular shape is formed in a central part at the lower edge of a plate-shaped insulating spacer 42 in the antenna part 40 and the flat antenna unit 35 is mounted on the antenna base 20 so as to be positioned inside the notch 42*a*. By mounting the antenna base 20 on the bottom of the antenna case 10, the antenna part 40, the amplifier substrate 34, and the flat antenna unit 35 can be housed in the internal space of the antenna case 10.

The configuration of the antenna base 20 is the same as that in the antenna apparatus 1 in the first embodiment and thus, a description thereof is omitted. The antenna base 20 has the pair of substrate fixing parts 23 to upright install and retain the antenna part 40 by sandwiching a lower edge of the insulating spacer 42 in the antenna part 40 formed on the front side thereof.

The antenna part 40 includes the insulating spacer 42 in an almost rectangular plate shape and a conductive (for example, made of metal) rod antenna device 41 fastened to the top end of the insulating spacer 42 and having an elongated rhomboid sectional shape. The insulating spacer 42 is made of an insulating material with good high frequency characteristics and has the notch 42*a* in a rectangular shape formed in the central part at the lower edge. The antenna device 41 can receive AM broadcasting and FM broadcasting and is constructed by forming a conducting film on the whole surface of a conductor such as a metal or an insulator whose width in the longitudinal direction is made larger than the thickness thereof. The antenna device 41 is fastened to the top end of the insulating spacer 42 by a lower part of the antenna device 41 being sandwiched by the top end of the insulating spacer 42 so that a pair of mounting screws 43 is tightened. Thus, by installing the antenna device 41 at a position as high as possible, like the first embodiment, electric characteristics of the antenna apparatus 3 can be improved. Incidentally, the sectional shape of the antenna device 41 is not limited to a rhomboid shape and may be an elliptical shape or polygonal shape, or the antenna device 41 in a plate shape may be adopted. Further, it becomes difficult to resonate the antenna device 41 in the FM wave band because the antenna device 41 is also an ultra-small antenna and thus, the inductor component becomes smaller. Therefore, by inserting an antenna coil 32 of about 1 μH to 3 μH to between a feeding point of the antenna device 41 and input of an amplifier in the amplifier substrate 34 in series, an antenna part consisting of the antenna device 41 and the antenna coil 32 is made to be resonated near the FM wave band. The antenna coil 32 is shown in FIG. 22. Further, the amplifier provided on the amplifier substrate 34 amplifies and outputs an FM broadcasting signal and an AM broadcasting signal received by the antenna device 41.

Also in the antenna apparatus 3 in the second embodiment of the present invention, as described above, the flat antenna unit 35 for receiving satellite radio broadcasting is installed immediately below the antenna device 41 for receiving AM/FM. The flat antenna unit 35 includes a patch element including a perturbation element and capable of receiving circular polarization. Moreover, in the antenna apparatus 3 in the second embodiment of the present invention, if the wavelength of the center frequency of a satellite digital radio in which the flat antenna unit 35 operates is λ, the interval D between the lower edge of the antenna device 41 and the upper surface of the flat antenna unit 35 is set to about 0.25λ or more. Further, the length L of the antenna device 41 is set to about 0.5λ or less, and the width h in the longitudinal direction of the antenna device 41 is set to about 0.2λ to 0.25λ, or about 0.2λ or less. Moreover, the antenna device 41 is made to have a width in the longitudinal direction larger than a thickness thereof and has a plate shape with thickness of 1 to 2 mm or a rod of about 1/60λ to 1/(one hundred+several tens)λ.

By setting dimensions/spatial relationships of the antenna device 41 as described above, a mutual influence between the antenna device 41 and the flat antenna unit 35 is reduced so that equivalent electric characteristics of each antenna when each of the antenna device 41 and the flat antenna unit 35 is present alone can be exhibited.

Industrial Applicability

An antenna apparatus according to the present invention described above can receive FM broadcasting and AM broadcasting excellently by an antenna device and receive satellite digital radio broadcasting by a flat antenna unit by installing the antenna device at a high position as far apart as possible from the ground and installing the flat antenna unit immediately below the antenna device. The satellite digital radio broadcasting is not limited to SDARS and satellite radio broadcasting of various frequency bands may be made receivable.

An antenna apparatus according to the present invention is assumed to be mounted on the roof or trunk of a vehicle, but the present invention is not limited to this and is applicable to an antenna apparatus that receives at least the FM band.

The invention claimed is:

1. An antenna apparatus, comprising:

an antenna substrate installed upright and on which a surface antenna device is formed;

an amplifier substrate on which an amplifier for amplifying a signal at least in an FM wave band received by the antenna device is provided and which is installed so as not to overlap with the antenna substrate;

a flat antenna unit having a patch element capable of receiving circular polarization, installed immediately below the antenna device and approximately perpendicular to a surface of the antenna device;

an antenna coil to resonate the antenna device in the FM wave band being inserted between a feeding point of the antenna device and input of the amplifier in the amplifier substrate; and an antenna case in which the antenna substrate, the amplifier substrate, the flat antenna unit, and the antenna coil are housed and which is mounted on a vehicle, wherein if a wavelength of a center frequency in an operating frequency band of the flat antenna unit is λ, an interval between an upper surface of the flat antenna unit and a lower end of the antenna device is about 0.25 λ or more.

2. The antenna apparatus according to claim 1, wherein the antenna substrate, the amplifier substrate, and the flat antenna unit are mounted on an antenna base and the antenna substrate, the amplifier substrate, the flat antenna unit, and the antenna coil are housed in the antenna case by the antenna case being fitted into the antenna base.

3. An antenna apparatus, comprising:

an insulation support means for supporting a plate-shaped antenna device, wherein a width in a longitudinal direction of the antenna device is made larger than a thickness of the antenna device;

an amplifier substrate on which an amplifier for amplifying a signal at least in an FM wave band received by the antenna device is provided and which is installed so as not to overlap with the insulation support means;

a flat antenna unit having a patch element capable of receiving circular polarization, installed immediately below the antenna device and approximately perpendicular to an axis in a longitudinal direction of the antenna device;

an antenna coil to resonate the antenna device in the FM wave band being inserted between a feeding point of the antenna device and input of the amplifier in the amplifier substrate; and an antenna case in which the insulation support means for supporting the antenna device, the amplifier substrate, the flat antenna unit, and the antenna coil are housed and which is mounted on a vehicle, wherein if a wavelength of a center frequency in an operating frequency band of the flat antenna unit is lambda, an interval between an upper surface of the flat antenna unit and a lower end of the antenna device is about 0.25 lambda or more.

4. The antenna apparatus according to claim 3, wherein the insulation support means for supporting the antenna device, the amplifier substrate, and the flat antenna unit are mounted on an antenna base and the insulation support means for supporting the antenna device, the amplifier substrate, the flat antenna unit, and the antenna coil are housed in the antenna case by the antenna case being fitted into the antenna base.

* * * * *